United States Patent [19]

Wichtermann et al.

[11] Patent Number: 4,996,747

[45] Date of Patent: Mar. 5, 1991

[54] COMBING MACHINE

[75] Inventors: Fredy Wichtermann, Effretikon; Gian-Carlo Mondini, Winterthur, both of Switzerland

[73] Assignee: Rieter Machine Works, Ltd., Winterthur, Switzerland

[21] Appl. No.: 431,431

[22] Filed: Nov. 3, 1989

[30] Foreign Application Priority Data

Nov. 3, 1988 [CH] Switzerland ..... 04086/88-7

[51] Int. Cl.[5] ..... D01G 19/08

[52] U.S. Cl. ..... 19/115 R; 19/225; 19/229

[58] Field of Search ..... 19/65 A, 65 R, 115 A, 19/115 R, 225, 229

[56] References Cited

U.S. PATENT DOCUMENTS

| | | | |
|---|---|---|---|
| 2,559,074 | 7/1951 | Hinson | 19/115 |
| 2,895,177 | 7/1959 | Foster | 19/120 |
| 3,440,688 | 4/1969 | Yamamoto et al. | 19/115 R |

FOREIGN PATENT DOCUMENTS

| | | | |
|---|---|---|---|
| 0328147 | 10/1920 | Fed. Rep. of Germany . | |
| 640041 | 12/1936 | Fed. Rep. of Germany | 19/229 |
| 0890150 | 1/1944 | France . | |
| 2401593 | 3/1979 | France . | |
| 436325 | 3/1968 | Japan | 19/115 R |
| 3042923 | 2/1988 | Japan | 19/115 R |
| 7095317 | 6/1988 | Japan | 19/115 R |
| 2043129 | 10/1980 | United Kingdom | 19/115 R |

*Primary Examiner*—Werner H. Schroeder
*Assistant Examiner*—Michael A. Neas
*Attorney, Agent, or Firm*—Kenyon & Kenyon

[57] ABSTRACT

The combing machine has at least one combing head having combing elements and a carrier for a lap roll for combing. Two pairs of transport rollers and a pair of pressing rollers are provided in the path of the lap from the lap roll to the combing elements. A movable deflector or element is also disposed adjacent the pressing rollers for a lap end. An automatic lap change is carried out when the lap has approximately completely unwound from the roll. The transport roller pairs are used to tear the lap therebetween with the resulting lap end advancing to the pressing rollers which is then stopped. After a fresh lap roll is placed in the machine, the forward end of the lap is moved between the transporting rollers and severed to form a second lap end. The deflector element serves to place the end of the fresh lap onto the previous lap end for combining within the pressure rolls.

27 Claims, 4 Drawing Sheets

COMBING MACHINE

This invention relates to a combing machine. More particularly, this invention relates to a combing machine for exchanging lap rolls.

As is known, various types of combing machines have been provided with a carrier means for supporting a lap roll as well as a combing head having combing elements for receiving and combing a lap supplied from the lap roll for example, as described in U.S. Pat. No. 2,895,177 and French Patent 2,401,593. It has also been known to dispose a detector, for example a photo electric cell or a light barrier in a combing machine of this kind in order to bring the machine to a stop when the end of a lap, i.e. a lap sliver runs, off the roll. In such cases, the carrier means is then refilled with a fresh lap roll either manually or by a transport means. The start of the lap from the fresh roll is then placed manually on the end of the lap from the previous roll. In some cases, the end of the lap from the previous roll may have to be torn to an appropriate length. The two lap ends are then connected by pressure, whereupon the machine can re-start.

Machines of the above type, however, require substantial time in order to carry out the piecing of the lap ends together. In addition, significant down time of the machine is required in order to bring about the connection of the fresh lap end to the previous lap end.

U.S. Pat. No. 2,559,074 describes a lap changer for a combing machine wherein a spare roll is mounted vertically above a working roll and which is dropped under gravity onto a nearly spent roll in the working position of the changer. In order to piece up the fresh lap onto the spent lap, the end of the spent lap is not allowed to unwind fully. Instead, the spent roll is allowed to sag to depress a trip in order to effect a change. However, such a structure is rather cumbersome and requires a significant amount of space relative to a combing head.

Accordingly, it is an object to the invention to automate the connection of a fresh lap to the end of a lap delivered to a combing elements of the combing machine.

It is another object of the invention to automate the operation of a combing machine in the supply of fresh lap to the machine.

It is another object of the invention to provide a combing machine of simple construction which is fully automated.

Briefly, the invention provides a combing machine with a carrier means for supporting a lap roll thereon and at least one combing head having a plurality of combing elements for receiving a lap from the carrier means and a first pair of transport rollers between the carrier means and the combing elements for conveying a lap therebetween.

In accordance with the invention, a means is provided for severing a lap extending between the transport rollers and the combing elements. In addition, a means is provided for connecting a first lap end from a lap extending in a upstream direction from the combing head with a second lap end from a lap extending in a downstream direction from the transport rollers.

In addition, a detector means is provided for determining the time at which a lap on a first lap roll on the carrier means has approximately completely left the lap roll as well as a control means which is responsive to the detector means in order to sequentially actuate the severing means to sever a first lap between the transport rollers and the combing elements in order to form a first lap end extending to the combing elements and to thereafter sever a second lap from a newly supplied lap roll and extending from the transport rollers to form a second lap end extending to the transport rollers.

The means for connecting the lap ends includes a pair of pressing rolls adjacent the combing elements and a deflector means is also provided in the form of a movable deflector element for directing a second lap end onto the first lap end adjacent the pressing rollers for combining between the pressing rollers.

The severing means may be formed of a second pair of transport rollers downstream of the first pair of transport rollers for conveying a lap therebetween and drive means for effecting a differential rotation between the pairs of transport rollers in order to sever a lap extending therebetween. The differential rotation between the pairs of transport rollers may be effected by driving one pair of transport rollers slower than the other or by rotating the pairs of transport rollers in opposite directions.

The control means which is actuated by the detector means is programmed to effect a sequence of operations of the respective transport rollers, pressing rollers and movable deflector element so as to effect an automatic piecing together of a fresh lap end to a lap end of a previously supplied lap. To this end, the control means first actuates the two pairs of transport rollers so as to sever a lap therebetween. The trailing end of the lap is then conveyed to a point short of the pressing rollers and the pressing rollers are stopped. The severed end of the lap which remains between the transport rollers of the first pair of transport rollers is then removed, for example, by continued rotation of these rollers or by a reverse rotation of the rollers. To this end, a suction device may be provided for drawing off the severed end of the lap.

Thereafter, after a fresh lap roll has been placed on the carrier means, the first pair of transport rollers is actuated so as to deliver the forward end of the fresh lap to the second pair of transport rollers. The two pairs of transport rollers are then actuated to sever the lap therebetween and thus form a second lap end. Thereafter, this second lap end is directed by the deflector element onto the lap at the pressing rollers and the pressing rollers re-started so as to affect combining of the lap ends.

The invention is particularly suitable for a combing machine comprising one or more groups of combing heads, e.g. a group of eight combing heads or two groups each of four combing heads. The lap roll change in all the combing heads of a group can then be performed simultaneously in each case. The above-described control means simultaneously performing the actuations at all the combing heads of the group. To start the control means, each combing head of the group is advantageously provided with its own detector means so that the control means is triggered as soon as the first lap sliver has approximately completely unwound from the first roll at a combing head of the group. The first lap slivers are then automatically severed at the same height at all the combing heads of the group, new rolls are supplied, the second lap slivers are severed from the new rolls at the same height and the lap ends are interconnected.

These and other objects and advantages of the invention will become more apparent from the following detailed description taken in conjunction with the accompanying drawings wherein:

FIG. 1 diagrammatically illustrates a combing machine constructed in accordance with the invention;

FIG. 2 schematically illustrates the combing machine in FIG. 1 at a time when a lap roll has been removed;

Figure 1:
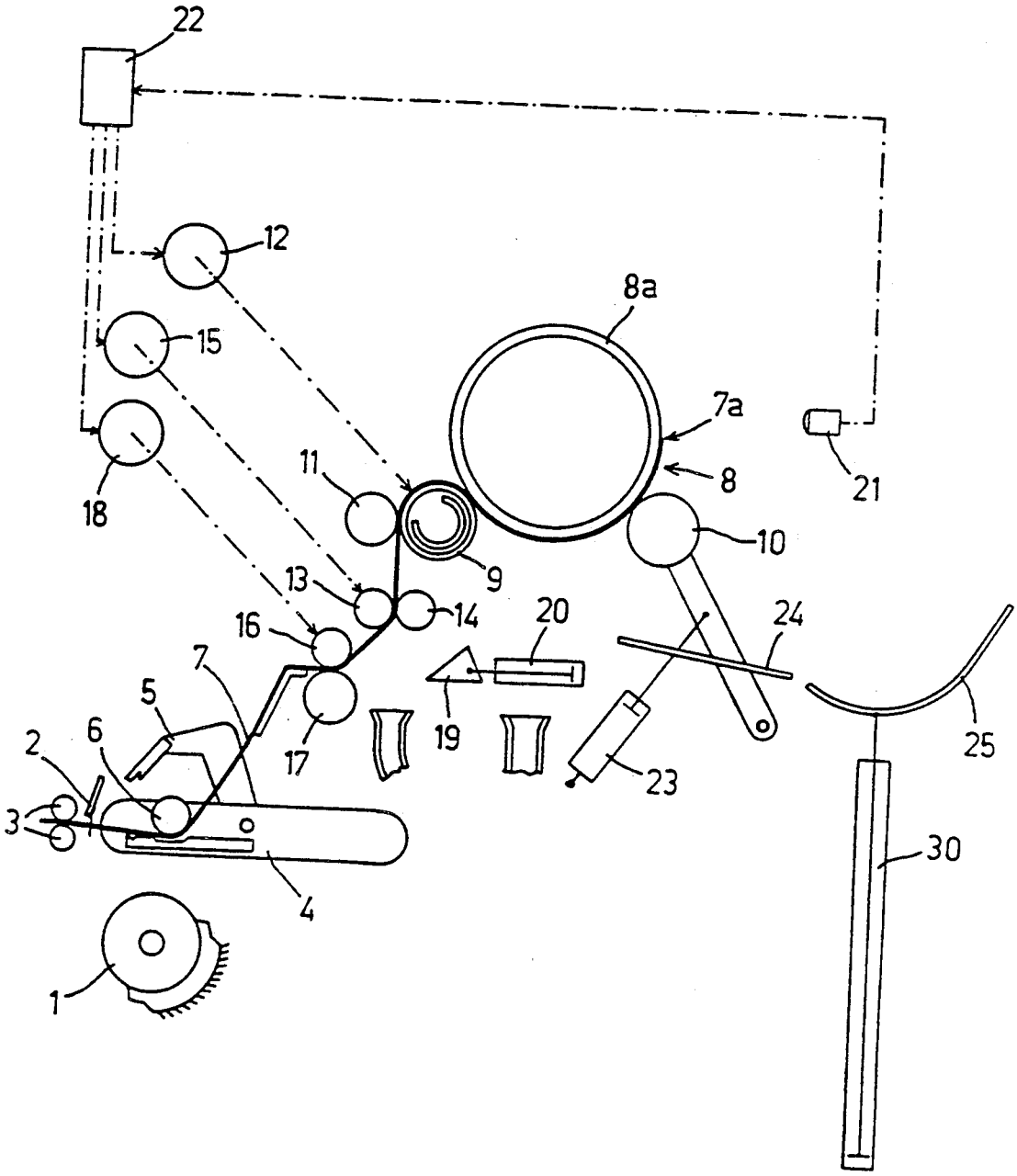

Referring to FIG. 1, the combing machine has a combing head which is provided with a plurality of cutting elements, such as, a circular comb 1, a top comb 2, two detaching rollers 3 and a nipper unit comprising a lower nipper 4 and an upper nipper 5 pivotable with respect to the lower nipper. A drivable feed roller 6 is mounted in the lower nipper 4 and a lap 7 for combing is fed to the roller 6.

The lap 7 in sliver form comes from a roll 8 carried by a carrier means which, in the embodiment illustrated, consists of two parallel lap rollers 9 and 10 on which the lap roll 8 bears.

The combing machine also has a pair of transport rollers 9, 11 for conveying the lap 7 from the lap roll 8. As illustrated, one of the rollers 9 of the carrier means serves as one of the transport rollers while the other roller 11 serves as a biasing roller. Alternatively, the transport rollers may be separate from the front lap roll 9. In either case, the transport rollers are driven by a drive means 12.

The combing machine also has a means of severing a lap 7 downstream of the transport rollers 9, 11. As illustrated, the severing means is in the form of a second transport roller pair 13, 14 disposed after the first transport roller pair 9, 11 and driven by a second controlled drive means 15. In normal operation of the combing machine, the two transport roller pairs 9, 11 and 13, 14 run at the same circumferential speeds. When a lap sliver is to be separated or torn, the drive means 12 and 15 are so controlled as explained hereinafter that they rotate the two transport roller pairs 9, 11 and 13, 14 to effect a differential rotation, e.g. by rotating the roller pairs at different circumferential speeds and/or in different directions, so the lap 7 tears between the two transport roller pairs. Alternatively, the first transport roller pair 9, 11 may be stopped and the second 13, 14 may continue to be driven or else the first roller pair 9, 11 may be driven in the opposite direction while the second pair 13, 14 is stationary. In either case, the lap sliver is severed.

The combing machine also has means for connecting the two lap ends together, i.e. the trailing lap end of the lap running to the combing elements 1–5 and the forward lap end of the lap extending from the fresh lap roll.

The means for connecting the first lap end to the second lap end comprises a pressing roller pair 16, 17 driven by a drive means 18, and a movable deflector element for at least one of two lap ends which are to be interconnected. In the embodiment illustrated, the deflector element is a slide 19 which is disposed upstream of the pressing roller pair 16, 17 in the direction of movement of the lap 7 and is moved, for example, by a piston and cylinder unit 20.

FIG. 1 shows the combing head as described in normal operation. The lap 7 is unwound from the roll 8 by rotation of the lap roller 9, is fed to the combing elements 1–5 by the pairs of transport rollers 13, 14 and 16, 17 rotating at the same circumferential speed, and is combed out by the combing elements. In FIG. 1, however, the lap sliver 7 has already practically completely unwound from the roll 8. This time is detected by a detector means, e.g. a photo-electric cell 21, which detects the passage of the end 7*a* of the lap 7 on the core 8*a* of the roll 8, by responding, for example, to the different brightnesses and/or colors of the lap 7 and of the core 8*a*. Of course, other detector means are possible for this purpose.

The detector means 21 delivers a signal to a control means 22 which then so controls the drive means 12, 15 and 18 and other drive means in the combing machine that a change of lap is performed automatically.

Figure 2:
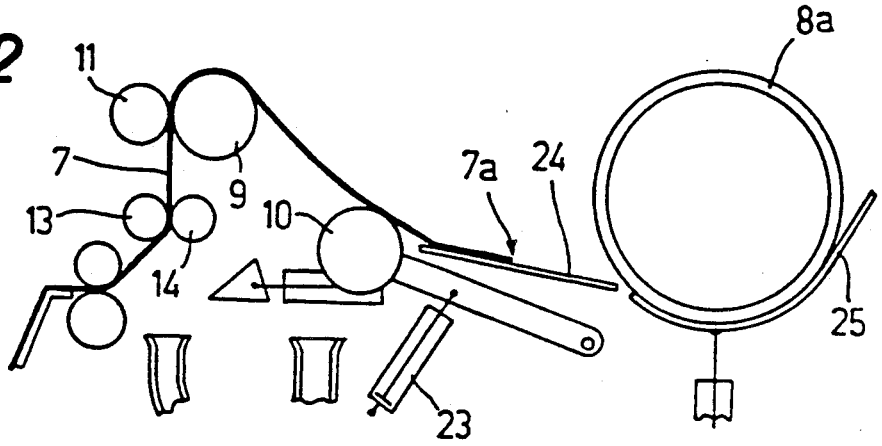

The control means 22 first actuates a piston and cylinder unit 23 which pivots the rear lap roller 10 away downwards as shown in FIG. 2. The almost empty core 8*a* therefore rolls by gravity rearwardly on a suitable guide 24 as far as a collector means in the form of a trough-shaped plate 25. The remaining lap is unwound from the core 8*a* in these conditions.

Figure 3:
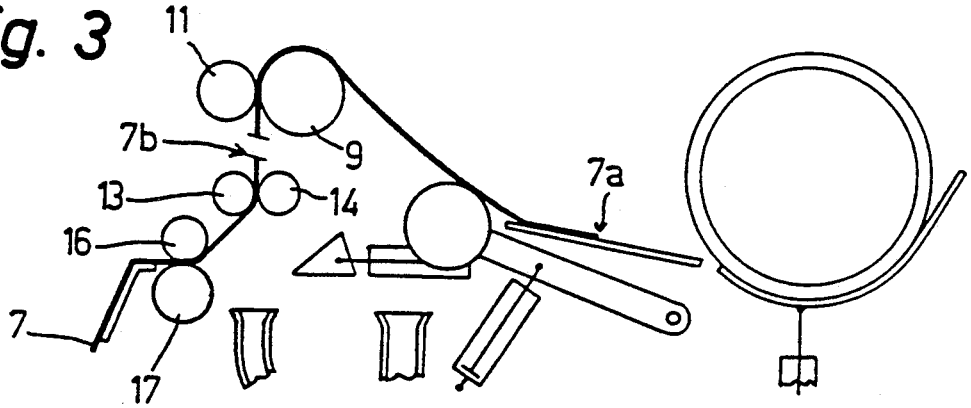
FIG. 3 illustrates a view similar to FIG. 2 at the time of formation of a first lap end on a delivered lap.

The control means 22 then controls the drive means 12 (FIG. 1) to stop the transport roller pair 9, 11 or rotates the same in the reverse direction. The lap 7 is therefore torn by the second transport roller pair 13, 14 which continues to rotate normally. The tearing takes place between the two transport roller pairs 9, 11 and 13, 14, so that a new rear lap end 7*b* is formed at an accurately defined location on the lap 7 running to the combing elements 1–5, as shown in FIG. 3.

Figure 4:
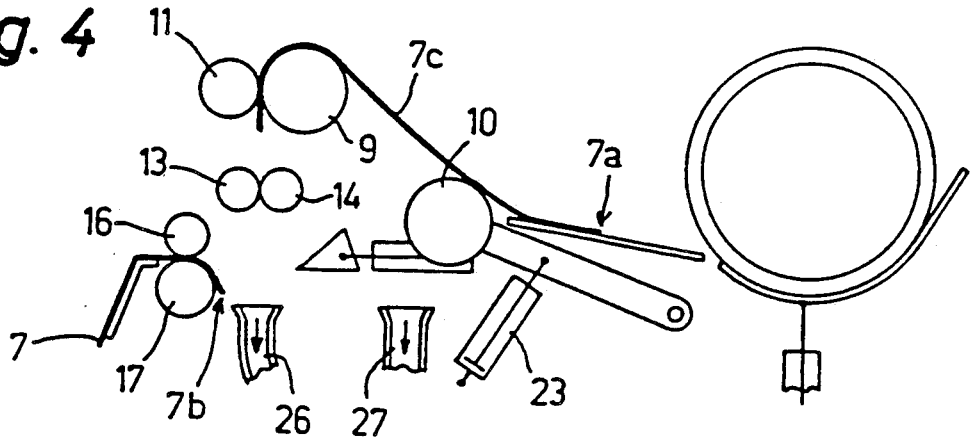
FIG. 4 illustrates a view of the combing machine after formation of a first lap end.

The second transport roller pair 13, 14 and the pressing roller pair 16, 17 continue to rotate until the newly formed rear lap end 7*b* stops just before the pressing roller pair 16, 17 as shown in FIG. 4. The drive means 18 of the pressing roller pair 16, 17 is then stopped and at the same time the combing elements 1–6 (FIG. 1) are also stopped.

When the first transport roller pair 9, 11 has simply been stopped to tear the lap 7, the severed rear end portion 7*c* of the lap 7 is still retained in the transport roller pair 9, 11 as shown in FIG. 4. The transport roller pair 9, 11 is therefore now rotated again in the forward direction together with the second transport roller pair 13, 14 to deliver the end portion 7*c* to a suction-extraction duct 26 by means of which the end portion 7*c* is removed. Alternatively, the end portion 7*c* may be removed by a suction-extraction duct 27 disposed further to the rear, the first transport roller pair 9, 11 now being rotated in the reverse direction until the start of the end portion 7*c* drops into this suction-extraction duct 27. If, however, the first transport roller pair 9, 11 has already been rotated sufficiently in the reverse direction to tear the lap 7, the start of the end portion 7*c* can drop without difficulty into the duct 27 and no further rotation is required.

The rear lap roller 10 is then pivoted back into the top position or the normal working position by actuation of the piston and cylinder unit 23.

Figure 5:
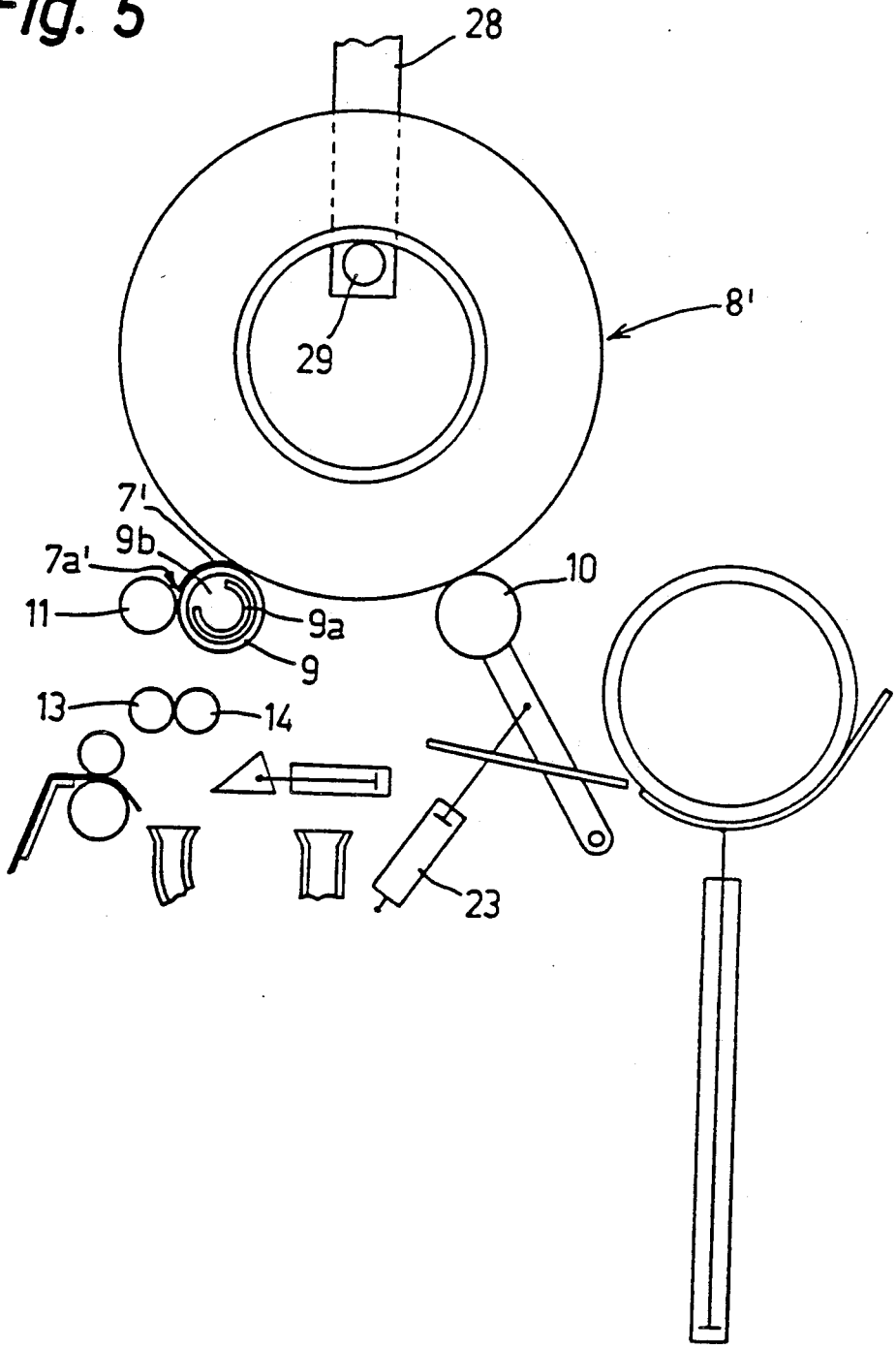
FIG. 5 illustrates a view of the combing machine during delivery of a fresh lap roll.

The control means 22 then actuates a lap roll transport device, of which FIG. 5 shows only an arm 28 with a supporting trunnion 29. The roll transport device brings up and places a new lap roll 8' on the lap rollers 9, 10.

The transport roller pairs, 9, 11 and 13, 14 are then rotated in the forward direction so that the lap roller 9 rotates the lap roll 8'. The surface of the lap roller 9 is air-permeable, e.g. perforate, and a stationary tube **9*a* is disposed in the interior and has a slot 9*b* in a top zone. Suction is now produced in this tube 9*a* so that air is sucked through the slot 9*b* and the air-permeable surface of the lap roller 9. The start 7*a'* of the lap sliver 7' from the fresh roll 8' is therefore subjected to suction from the lap roller 9 as soon as the start 7*a'* reaches the latter. Consequently, as shown in FIG. 5, the start 7*a'* is applied to the circumference of the lap roller 9. The lap 7' is then moved downwards by the transport roller pairs 9, 11 and 13, 14**.

Figure 6:
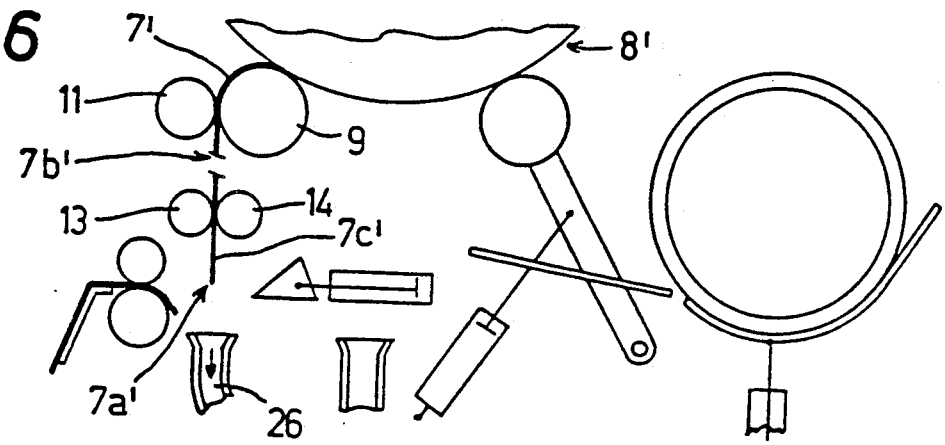
FIG. 6 illustrates the combing machine at a position during severance of the freshly delivered lap to form a second lap end in accordance with the invention.

After the start **7*a'* of the lap sliver 7' has passed through the second transport roller pair 13, 14, the first transport roller pair 9, 11 is stopped after a predetermined interval or else the second transport roller pair 13, 14 is accelerated with respect to the 20 first pair 9, 11. As a result, the lap 7' is torn between the two transport roller pairs, 9, 11 and 13, 14 i.e., a new front lap end 7*b'* is formed at an accurately defined location on the lap 7' coming from the roll 8' as shown in FIG. 6**.

The severed end portion **7*c'* of the lap 7' is then sucked into the suction-extraction duct 26 and removed after passing completely through the second transport roller pair 13, 14**.

Figure 7:
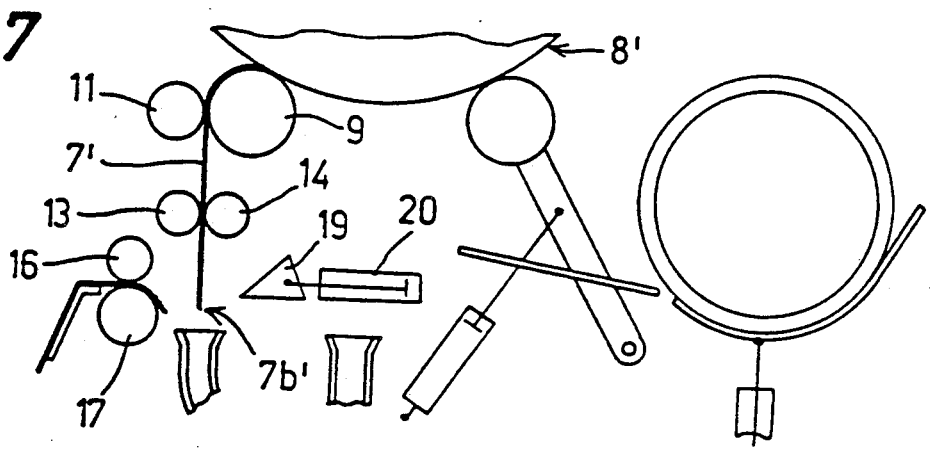
FIG. 7 illustrates a view of the combing machine at a point prior to combing of the severed lap ends in accordance with the invention.
Figure 8:
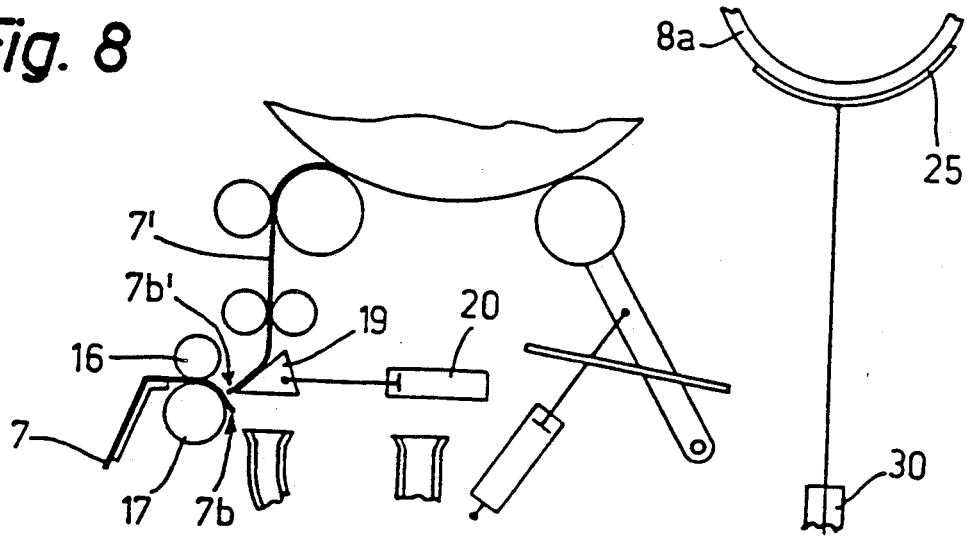
FIG. 8 illustrates a view similar to FIG. 7 with the deflector element adjacent the pressing rollers for the delivery of a lap thereto.

The two transport roller pairs 9, 11 and 13, 14 then continue to run at the same circumferential speeds and move the lap 7' downwards as the lap 7' comes from the roll 8, Once the new front lap end **7*b'* has approximately reached the position shown in FIG. 7 in front of the pressing roller pair 16, 17 or between the latter and the slide 19, the control means 22 actuates the piston end cylinder unit 20 to move the slide 19 to the left against the pressing roller pair 16, 17. As shown in FIG. 8, in these conditions, the slide 19 comes into contact with and places the front lap end 7*b'* on the rear lap end 7*b* of the lap 7 which is still held in the nip of the pressing roller pair 16, 17 and projects therefrom, resting partially on the circumference of the bottom pressing roller 17**.

The drive means 18 for the pressing roller pair 16, 17 and at the same time the drive means (not shown) for the combing elements 1–6 are then switched on again. The rear **7*b* of the lap 7 is pulled, together with the front end 7*b'* of the lap 7' resting thereon, into the pressing roller pair 16, 17 which presses the two ends 7*b* and 7*b'* together and joins them. In these conditions, the slide 19** is again pulled back to the right by the piston and cylinder unit. The combing head then resumes normal operation.

FIG. 8 also shows that the collecting means 25 with the empty roll core **8*a* laying thereon has been lifted into an upper position by a drive means in the form of a piston and cylinder unit 30. In this upper position, the empty roll core 8*a* is engaged and discharged by the roll transport means 28, 29 (FIG. 5), whereupon the collecting means 25 is again lowered into the starting position, as shown in FIG. 1**.

The combing head can be disposed in a combing machine in a group of combing heads in which combined drive means are provided for the combing elements 1–5 of all the combing heads of the group. The control means 22 is then associated jointly with all the combing heads of the group. The drive means controlled by the control means 22, more particularly the drive means 12, 15 and 18, and the piston and cylinder units 20, 23 and 30, together with the means for generating suction in the front lap roller 9 and in the suction-extraction ducts 26 and 27 and the roll transport means (28,29) can also be associated jointly with all the combing heads of the group (although the common control means could in principle also control separate drive means and so on).

On the other hand, each combing head of the group has its own associated detector means 21 (FIG. 1). As soon as the lap sliver 7 has substantially completely unwound from the roll 8 at one of the combing heads, the associated detector means 21 delivers a signal to the common control means 22 which then simultaneously performs the above-described lap roll change at all the combing heads of the group. At the start of the lap roll change operation, there may still be different lengths of lap 7 on the lap roll cores **8*a* in the various combing heads of the group. Then new rear lap ends 7*b* formed by the simultaneous severing (tearing) of the lap slivers 7 between the transport roller pairs 9, 11 and 13, 14 are, however, then at the same height in all the combing heads of the group. Similarly, the new front lap ends 7*b'* formed by tearing the new lap slivers 7' are at the same height in all the combing heads even if the start 7*a'* of the lap on the new lap rolls' 8' supplied by the lap roll transport means (28,29) did not lie exactly at the same place on the circumference. The front lap ends 7*b'* can therefore then be joined to the rear lap ends 7*b* without difficulty in the same way in all the combing heads by the slides 19 (or a common slide 19) and the pressing rollers 16, 17**.

In the combing head described, on the change of lap, both the lap 7 and then the lap 7' are respectively severed or torn from the lap roll 8 and the new lap roll 8' by differential drive of the two transport roller pairs 9, 11 and 13, 14. In modified embodiments, however, separate means could of course be provided for severing the lap 7 and for severing the lap 7'. Also, there is no absolute need for a second transport roller pair for severing purposes. Instead, other severing means adapted to be actuated by the control means 22 may be provided.

The sequence of operation of the various components of the combing machine is controlled by the control means 22 as well as the timing of each. In addition, suitable sensors may be provided, for example, adjacent the pressing rollers 16, 17 to sense when the trailing end of a lap **7*b* arrives near the pressing roller 16, 17, for example, at the point indicated in FIG. 4. Similar sensors may also be provided to sense when the start 7*a'* of a lap 7' has passed between the first pair of transport rollers 9, 11. The restart of the pressing rollers 16, 17 occurs, for example when the front end of the start 7*a'* of the new lap 7' arise at a predetermined position at the pressing rollers 16, 17**, e.g. as determined by a sensor.

The invention thus provides the combing machine in which the piecing of a fresh lap to a previously delivered lap can be automatically effected.

What is claimed is:

1. A combining machine comprising a carrier means for supporting a lap roll thereon;

at least one combing head having a plurality of combining elements for receiving a lap from said carrier means;

a first pair of transport rollers between said carrier means and said combing elements for conveying a lap therebetween in a first direction of travel;

means for severing a lap extending between said first pair of transport rollers and said combining elements; and means for connecting a first lap end from a lap extending in an upstream direction relative to said direction of travel from said combing head with a second lap end from a lap extending in a downstream direction relative to said direction of travel from said transport rollers, said connecting means including a pair of pressing rollers downstream of said transport rollers and a movable deflector element adjacent said pressing rollers for combining the lap ends together for passage between said pressing rollers.

2. A combining machine as set forth in claim 1 which further comprises a detector means for determining the time when a lap on a first lap roll on said carrier means has approximately completely left the lap roll; transport means for feeding a fresh lap roll to said carrier means; and a control means responsive to said detector means to sequentially actuate said means for severing a lap to form the first lap end, said transport means to feed a fresh lap roll to said carrier means, said means for severing a lap to form the second lap end and then means for connecting the lap ends.

3. A combing machine as set forth in claim 2 comprising a plurality of combing heads and a plurality of said detector means, each said detector means being associated with a respective combing head and connected to said control means to activate said control means to simultaneously actuate said combing heads.

4. A combing machine as set forth in claim 1 which further comprises means for removing a lap portion adjacent said severing means.

5. A combing machine as set forth in claim 4 wherein said means for removing a lap portion includes at least one suction duct.

6. A combing machine as set forth in claim 1 wherein said means for severing includes a second pair of transport rollers downstream of said first pair of transport rollers relative to said direction of travel for conveying a lap therebetween and drive means for effecting a differential rotation between said pairs of transport rollers to sever a lap extending therebetween.

7. A combing machine as set forth in claim 6 which further comprises a detector means for determining the time at which a lap on a first lap roll on said carrier means has approximately completely left the lap roll; transport means for feeding a fresh lap roll to said carrier means; and a control means responsive to said detector means to sequentially actuate said drive means of said severing means to form a first lap end and to pass the lap end to said pressing rollers, said pressing rollers to stop movement of the first lap end therebetween, said transport rollers to feed a second lap, said severing means to form a second lap end extending in a downstream direction from said transport rollers relative to said direction of travel, said transport rollers to feed the second lap end to said pressing rollers, and then said movable deflector element to move the second lap end onto the first lap end thereat.

8. A combing machine as set forth in claim 1 wherein said carrier means includes a pair of lap rollers for supporting a lap roll thereon, and means for lowering one of said lap rollers to permit rolling of a lap roll from said lap rollers.

9. A combing machine as set forth in claim 8 which further comprises a collector means for receiving a lap roll from said lap rollers in response to lowering of said one lap roller.

10. A combing machine as set forth in claim 1 wherein said carrier means includes a front lap roller and a rear lap roller for supporting a lap roll thereon, said front lap roller being air-permeable to permit a vacuum generated therein to release the start of a lap roll on said front and rear lap rollers.

11. A combing machine as set forth in claim 1 wherein said carrier means includes a lap roller cooperating with one of said transport rollers to support a lap roll thereon.

12. A combing machine as set forth in claim 1 wherein said movable element is movable towards said pressing rollers to press the second lap end onto the first lap end.

13. A combing machine comprising a carrier means for supporting a lap roll thereon;

a plurality of combing elements for receiving and combing a lap from said carrier means;

a first pair of transport rollers between said carrier means and said combing elements for conveying a lap therebetween;

a second pair of transport rollers between said first pair of transport rollers and said combing elements for conveying a lap therebetween;

a pair of pressing rollers between said second pair of transport rollers and said combing elements;

a movable deflector element adjacent said pressing rollers for directing a lap end between said pressing rollers; and control means to sequentially actuate said pairs of transport rollers to effect a differential rotation therebetween to sever a lap extending therebetween to form a first lap end, said pressing rollers to stop conveyance of the lap therebetween, said first pair of transport rollers to deliver a fresh lap, said pairs of transport rollers to sever the fresh lap therebetween to form a second lap end and then said deflector element to move the second lap end onto the first lap end and said pressing rollers to combine the lap ends.

14. A combing machine as set forth in claim 13 which further comprises a detector means for actuating said control means in response to emptying of a lap from a lap roll on said carrier means.

15. A combing machine as set forth in claim 14 wherein said carrier means includes a pair of lap rollers for supporting a lap roll thereon, and means for lowering one of said lap rollers to permit rolling of a lap roll from said lap rollers.

16. A combing machine as set forth in claim 15 which further comprises a collector means for receiving a lap roll from said lap rollers in response to lowering of said one lap roller.

17. In a combing machine, the combination comprising carrier means for supporting a lap roll thereon;

a first pair of transport rollers for conveying a lap from a lap roll on said carrier means in a first direction of travel;

a pair of pressing rollers downstream of said transport rollers relative to said direction of travel to receive a lap therefrom;

a plurality of combing elements downstream of said pressing elements relative to said direction of travel for receiving a combing a lap therefrom severing means disposed between said transport rollers and said pressing rollers to sever a lap extending therebetween;

control means connected to said severing means to sequentially actuate said severing means to sever a first lap between said transport rollers and said pressing rollers to form a first lap end extending to said pressing rollers and to thereafter sever a second lap extending from said transport rollers to form a second lap end extending to said transport rollers; and deflector means for directing the second lap end onto the first lap end adjacent said pressing rollers for combining therebetween.

18. The combination as set forth in claim 17 wherein said severing means includes a second pair of transport rollers for conveying the lap therebetween and drive means for effecting a differential rotation between said pairs of transport rollers to tear a lap extending therebetween.

19. The combination as set forth in claim 18 which further comprises a detector means for determining the time when a lap on a first lap roll on said carrier means has approximately completely left the lap roll and transport means for feeding a fresh lap roll to said carrier means.

20. The combination as set forth in claim 18 wherein said control means is connected to said first pair of transport rollers, said pressing rollers and said deflector element to actuate said rollers and element in timed sequence with said second pair of transport rollers.

21. In a combing machine, the combination comprising carrier means for supporting a lap roll thereon;

a first pair of transport rollers for conveying a lap from a lap roll on said carrier means in a first direction of travel;

a pair of pressing rollers downstream of said transport rollers relative to said direction of travel to receive a lap therefrom;

a plurality of combing elements downstream of said pressing rollers relative to said direction of travel for receiving and combing a lap therefrom;

severing means disposed between said transport rollers and said pressing rollers to sever a lap extending therebetween; and control means connected to said severing means to sequentially actuate said severing means to sever a first lap between said transport rollers and said pressing rollers to form a first lap end extending to said pressing rollers and to thereafter sever a second lap extending from said transport rollers to form a second lap end extending to said transport rollers for subsequent superposition with said first lap end for passage through said pressing rollers.

22. A combing machine as set forth in claim 21 wherein said means for severing includes a second pair of transport rollers downstream of said first pair of transport rollers relative to said direction of travel for conveying a lap therebetween and drive means for effecting a differential rotation between said pairs of transport rollers to sever a lap extending therebetween.

23. A combing machine as set forth in claim 22 which further comprises a detector means for determining the time when a lap on first lap roller on said carrier means has approximately completely left the lap roll, transport means for feeding a fresh lap roll to said carrier means, and a control means responsive to said detector means to sequentially actuate said drive means of said severing means to form a first lap end and to pass the lap end to said pressing rollers, said pressing rollers to stop movement of the first lap end therebetween, said transport rollers to feed a second lap, said severing means to form a second lap end extending in a downstream direction from said transport rollers relative to said direction of travel, said transport rollers to feed the second lap end to said pressing rollers, and then said movable deflector element to move the second lap end onto the first lap end thereat.

24. A combing machine as set forth in claim 21 which further comprises a suction duct for removing a lap portion adjacent said severing means.

25. A method of joining an incoming lap with an outgoing lap in a combing machine comprising the steps of severing an outgoing lap upstream of the combing machine relative to the direction of lap movement;

supporting a severed length of the outgoing lap extending from the combing machine;

bringing the end of an incoming lap from a lap carrier together with the end of the outgoing lap at a lap joining means;

joining the ends of the outgoing lap and incoming lap together in the lap joining means; and thereafter feeding the joined laps to the combing machine.

26. A method as set forth in claim 25 further comprising the steps of determining the time at which a lap on a first lap roll on the carrier means has approximately completely left the lap roll;

feeding a fresh lap roll to the carrier means; and sequentially severing the outgoing lap to form a first lap end, feeding the fresh lap roll to the carrier means, severing the lap from the fresh lap roll to form a second lap end and thereafter bringing the lap ends together.

27. A method of connecting lap ends in a combing machine comprising the steps of severing a lap extending between a pair of pressing rollers and a pair of transport rollers to form a first lap end extending to said pressing rollers;

thereafter severing a second lap extending from said transport rollers to a lap roll on a carrier means to form a second lap end extending to said transport rollers;

superimposing the second lap end on the first lap end; and passing the superimposed ends through said pressure rollers to piece said ends together.

* * * * *

UNITED STATES PATENT AND TRADEMARK OFFICE

CERTIFICATE OF CORRECTION

PATENT NO. : 4,996,747

DATED : March 5, 1991

INVENTOR(S) : Fredy Wichtermann, et al

It is certified that error appears in the above-identified patent and that said Letters Patent is hereby corrected as shown below:

Title Page:
In the Abstract, line 6 delete "or"
Column 1, line 16 change "runs," to -, runs;
Column 1, line 61 change "a" to -an-
Column 2, line 47 change "affect" to -effect-
Column 2, line 55 change "performing" to -performs-
Column 5, line 27 delete "20"
Column 5, line 39 change "8," to -8'.-
Column 6, line 26 change "Then" to -The-
Column 6, line 33 chcange "rolls'" to -rolls-
Column 6, line 63 change "the" to -a-
Column 7, lines 1 and 2 change "combining" to -combing-
Column 7, line 8 change "combining" to -combing-
Column 7, line 21 change "combining" to -combing-
Column 8, line 21 change "element" to -deflector element-
Column 9, line 6 change "a" to -and-
Column 10, line 7 change "on first" to -on a first-
Column 10, line 42 change "at which" to -when-

Signed and Sealed this

Sixth Day of October, 1992

*Attest:*

DOUGLAS B. COMER

*Attesting Officer*

*Acting Commissioner of Patents and Trademarks*